US008992187B2

(12) United States Patent
Hartl et al.

(10) Patent No.: US 8,992,187 B2
(45) Date of Patent: Mar. 31, 2015

(54) AIR-COOLED RECIPROCATING COMPRESSOR HAVING SPECIAL COOLING AIR CONDUCTION

(71) Applicant: KNORR-BREMSE Systeme fuer Schienenfahrzeuge GmbH, Munich (DE)

(72) Inventors: Michael Hartl, Unterhaching (DE); Juergen Mendel, Molfsee-Rammsee (DE); Joerg Mellar, Pliening (DE); Matthias Fritz, Erfurt (DE)

(73) Assignee: KNORR-BREMSE Systeme fuer Schienenfahrzeuge GmbH, Munich (DE)

( * ) Notice: Subject to any disclaimer, the term of this patent is extended or adjusted under 35 U.S.C. 154(b) by 0 days.

(21) Appl. No.: 13/718,168

(22) Filed: Dec. 18, 2012

(65) Prior Publication Data

US 2013/0108487 A1 May 2, 2013

Related U.S. Application Data

(63) Continuation of application No. PCT/EP2011/059782, filed on Jun. 14, 2011.

(30) Foreign Application Priority Data

Jun. 18, 2010 (DE) ..... 10 2010 024 346

(51) Int. Cl.
*F04B 39/02* (2006.01)
*F04B 39/06* (2006.01)
(Continued)

(52) U.S. Cl.
CPC ..... *F04B 39/064* (2013.01); *F04B 25/005* (2013.01); *F04B 27/005* (2013.01); *F04B 39/066* (2013.01); *F04B 17/03* (2013.01)
USPC ..... 417/368

(58) Field of Classification Search
CPC ..... F04B 39/06; F04B 39/064; F04B 39/066
USPC ..... 417/366, 368; 62/324.6, 401, 507, 508
See application file for complete search history.

(56) References Cited

U.S. PATENT DOCUMENTS 2,917,226 A 12/1959 Scheiterlein
4,350,475 A * 9/1982 Meece et al. ..... 417/238
(Continued)

FOREIGN PATENT DOCUMENTS

CN 101253327 A 8/2008
DE 1 089 921 B 9/1960
(Continued)

OTHER PUBLICATIONS

Machine Translation of DE 102007019126 patent provided with Applicant's Information Disclosure Statement.*
(Continued)

*Primary Examiner* — Peter J Bertheaud
*Assistant Examiner* — Dnyanesh Kasture
(74) *Attorney, Agent, or Firm* — Crowell & Moring LLP

(57) ABSTRACT

An air-cooled reciprocating compressor for vehicles includes a compressing unit, which has a plurality of cylinders and is driven by a motor and has a fan for generating a cooling air flow. The fan is disposed on a connecting shaft between the motor and the compressing unit and takes in cooling air from the surroundings and delivers cooling air to a downstream cooling air duct, wherein the cooling air duct at least partially surrounds the cylinders and is designed such that cooling air can flow around all in-line cylinders of the compressing unit.

15 Claims, 1 Drawing Sheet

(51) Int. Cl.

| | |
|---|---|
| ***F04B 25/00*** | (2006.01) |
| ***F04B 27/00*** | (2006.01) |
| ***F04B 17/03*** | (2006.01) |

(56) References Cited

U.S. PATENT DOCUMENTS

| | | | | |
|---|---|---|---|---|
| 7,059,147 | B2 * | 6/2006 | Inoue | 62/244 |
| 8,308,447 | B2 | 11/2012 | Hartl | |
| 8,317,488 | B2 | 11/2012 | Hartl | |
| 2006/0024160 | A1 * | 2/2006 | Horng et al. | 415/206 |
| 2006/0093499 | A1 * | 5/2006 | Horng et al. | 417/423.1 |
| 2007/0007830 | A1 * | 1/2007 | Reisch et al. | 310/54 |
| 2007/0292289 | A1 * | 12/2007 | Hartl | 417/545 |
| 2008/0053749 | A1 * | 3/2008 | Utsunomiya | 181/286 |

FOREIGN PATENT DOCUMENTS

| | | | |
|---|---|---|---|
| DE | 24 22 448 | A1 | 11/1975 |
| DE | 101 38 070 | C2 | 5/2003 |
| DE | 10 2004 042 944 | A1 | 3/2006 |
| DE | 10 2005 040 495 | B3 | 8/2006 |
| DE | 10 2007 019 126 | A1 | 10/2008 |
| DE | 10 2007 019 126 | B4 | 7/2009 |
| DE | 10 2004 042 944 | B4 | 9/2009 |
| GB | 216157 | A | 11/1924 |

OTHER PUBLICATIONS

International Search Report with English translation dated Oct. 5, 2011 (four (4) pages).

German Office Action with English translation dated Jun. 29, 2011 (nine (9) pages).

International Preliminary Report on Patentability (PCT/IB/338 & PCT/IB/373), including Written Opinion (PCT/ISA/237) dated Jan. 3, 2013 (eight (8) pages).

Chinese Office Action dated Sep. 2, 2014 (Eight (8) pages).

* cited by examiner

AIR-COOLED RECIPROCATING COMPRESSOR HAVING SPECIAL COOLING AIR CONDUCTION

CROSS-REFERENCE TO RELATED APPLICATIONS

This application is a continuation of PCT International Application No. PCT/EP2011/059782, filed Jun. 14, 2011, which claims priority under 35 U.S.C. §119 from German Patent Application No. DE 10 2010 024 346.9, filed Jun. 18, 2010, the entire disclosures of which are herein expressly incorporated by reference.

BACKGROUND AND SUMMARY OF THE INVENTION

The invention relates to an air-cooled piston compressor for use in vehicles, in particular commercial vehicles, having a compressing unit with a plurality of cylinders and being driven by a motor, and also having a fan for generating a cooling air flow to cool the cylinders in particular.

The field of application of the invention is primarily oil-free piston compressors with multi-cylinder designs, which work in a single stage even at high operating pressures. The cylinders are cooled by means of a cooling air flow.

In commercial vehicles, in particular buses which are formed as electric or hybrid vehicles, recently increasingly often compressor designs have been tested in which the compressor is driven by an electric motor which, for example, is fed by a generator and a rectifier and installed at locations in the vehicle at which no cooling water is available, but where often high ambient temperatures predominate. In such vehicles, the compressed air generated by the compressor is used, in particular, to operate the vehicle brakes.

In particular for use in electric and hybrid vehicles, oil-free compressing compressors of the type described above are required which work reliably at extreme ambient temperatures, at low cost and in very small construction spaces, while covering a high air demand with little maintenance. In oil-free compressor designs, there is no oil filling of the compressor housing in the conventional sense. Lubrication of the piston running surfaces is replaced by a low-friction piston coating. The rotating parts are mounted on roller bearings with temperature-resistant long-life grease. In the valves, guided parts which could generate friction heat are avoided.

In the past in commercial vehicles, in contrast to this, oil-lubricated reciprocating compressors have been used to generate the compressed air. These are usually flanged directly to the combustion engine of the vehicle and are normally driven via gears. Cooling takes place via cooling water which is branched from the combustion engine.

For other consumers, for example to supply pneumatic assemblies mounted on commercial vehicles, air-cooled compressors have rather been used previously. In particular in these applications, air-cooled reciprocating compressors are often fitted with axial fans which are mounted unilaterally on and driven by the crankshaft of the reciprocating compressor. These reciprocating compressors are often designed as W-, V- or star-shaped constructions so that the cooling air from the axial fan can be conducted as uniformly as possible over all cylinders. If, however, cylinders are concealed by other cylinders in the direction of the cooling flow—for example on an in-line arrangement—there is a danger of overheating. To prevent overheating, such air-cooled reciprocating compressors are designed as two-stage or multistage units for operating pressures above 8 bar, in order to keep the component temperatures low. Such multistage compressor designs are often generally used in the prior art in brake air compressors in rail vehicle construction. Some types work with simple air deflectors which conduct the cooling air as closely as possible past the concealed cylinders in order to cool these better.

In practice, oil-free reciprocating compressor concepts in single-stage design cannot be used for pressures above 10 bar, in particular in air-cooled designs, because the required component life could not be achieved due to the high component temperatures resulting from the high rotation speed and power density in very small construction spaces. For air-cooled, single-stage, oil-free, reciprocating compressors in in-line construction with an axial fan on the end of the crankshaft, the problem exists that at the cylinder standing in the shadow of another cylinder, even when air deflectors are used, the concealed cylinder overheats so that the piston rings and bearing grease on the connecting rod bearings of this cylinder wear rapidly. In particular at locations in commercial vehicles where no cooling water is available, only compressors in air-cooled design can be used. Cooling the roller bearings and cylinders then constitutes a particular challenge. Because of the limited construction space, no additional fan or cooling air conducts can be used. To lower the bearing temperatures, so far oil-free compressor concepts have been known in which the intake air is guided through the crankcase. This leads to heating of the intake air which leads to an increase in compression end temperatures, whereby again the overall temperature level of the compressor rises. This concept has therefore proved unsuitable as a whole for single-stage compressors.

DE 101 38 070 C2 discloses a technical solution for reducing the temperatures in the crankcase of an oil-free two-stage compressor. Here, the change in volume caused by the piston movement is used to generate a cooling air flow. The cooling air is used primarily for jacket cooling of the cylinders, but also to ventilate the crankcase. The disadvantage of this design, however, is that the ventilation is not fully integrated in the compressor, so lateral cooling air feeds and additional filter systems to clean the cooling air are required. Furthermore, contamination and water can collect in the crankcase. This solution has therefore proved unsuitable for single-stage compressors.

DE 10 2004 042 944 A1 describes a reciprocating compressor with a crankcase ventilation in which the cooling air is branched from the compressor intake air. The disadvantage of this solution is that the cooling air has already been preheated in the cylinder head, and hence the efficiency and thermal behavior of the compressor deteriorate. Admittedly the temperature problem in relation to the crankcase has been resolved; the temperature problem in the cylinder region, however, persists.

DE 10 2005 040 495 A1 proposes a further approach for crankcase cooling of an oil-free multicylinder compressor. Here the cooling air volume flow is generated through the crankcase by dividing the crankcase such that each cylinder has its own crankcase chamber. A particular difficulty here is the mounting of the crank drive since intermediate crankshaft bearings are present inside the crankcase. The technical solution has therefore proved very complex in production terms.

The object of the present invention is therefore to create a multicylinder, single-stage, compact, air-cooled reciprocating compressor which is simple to install and works reliably with air cooling even at high pressures, wherein uniform cylinder wall and crankcase temperatures can be set on all cylinders.

This and other objects are achieved by providing an air-cooled reciprocating compressor for vehicles with a compressing unit which has a plurality of cylinders and is driven by a motor and has a fan for generating a cooling air flow. The fan is arranged on a connecting shaft between the motor and the compressing unit and draws in cooling air from the environment and delivers the cooling air to a downstream cooling air duct. The cooling air duct at least partially surrounds the cylinders and is configured such that cooling air can flow uniformly around all in-line cylinders of the compressing unit.

The invention thus provides for a fan to be arranged on a connecting shaft between the motor and the compressing unit for drawing in the cooling air from the environment and delivering this to a downstream cooling air duct, wherein the cooling air duct at least partially surrounding the cylinders is designed such that cooling air can flow uniformly around all in-line cylinders of the compressing unit.

The advantage of this solution according to the invention is expressed, in particular, in that piston and piston ring wear, and wear of lubricants at the bearing points, is uniformly low at all cylinders. In addition, the air-cooled reciprocating compressor according to the invention achieves a long service life without maintenance, so that the service intervals of the vehicle or the vehicle life can be improved even without exchange. The compressing unit of the reciprocating compressor according to the invention can be designed oil-free and advantageously therefore produces oil-free compressed air, which solves the problems of oiling and coking which frequently occur in brake systems in commercial vehicle construction. The absence of oil in the compressing unit, in addition, solves the problem of condensate disposal and emulsion binding in the oil. In particular, the air-cooled reciprocating compressor according to the invention can be used in commercial vehicles as it is characterized by a sufficiently high power density at high rotation speeds.

The air flow around the cylinders of the compressing unit is conducted by the cooling air duct mainly on two sides and perpendicular to the direction of rotation of the compressor. As a result the cooling air flow is uniformly conducted to the locations to be cooled and divided according to the number of components to be cooled.

According to another aspect of the invention, the cross section of the cooling air duct is not kept constant along the flow direction in order to generate a uniform cooling air flow, but different cross sections are selected in a targeted manner. Thus, the cylinder which lies closest to the fan undergoes a reduction in the cooling air supply due to a constriction of the cross section, so that other cylinders further away from the fan receive approximately the same cooling air as the closer cylinder. This advantage can be achieved merely by a corresponding dimensioning of the component forming the cooling air. Preferably, such a cooling air duct is formed by a two-piece plastic housing, the two halves of which can easily be produced in molds with simple mold division, preferably by injection molding.

According to a further aspect of the invention, the cooling air duct recombines the cooling air in the flow direction after the cylinders so that this can be extracted from the hot zone of the cylinders towards the outside via a common extraction air duct in a targeted manner. Because the consumed, i.e. the heated, cooling air does not flow towards the outside at different locations on the compressing unit, the consumed cooling air can be extracted towards the outside in a targeted manner, if necessary via a further hose extension.

Preferably the fan arranged between the motor compressor is designed as a type of radial fan. Such a radial fan can be installed particularly compactly between the components without increasing the external geometric dimensions of the entire air-cooled reciprocating compressor disproportionately.

Such a radial fan according to a preferred embodiment first blows the in-drawn cooling air radially away from the rotation axis of the compressor, whereafter a deflection of cooling air flow by the cooling air duct takes place first in the axial direction of the compressor axis, in order then to blow away again in the radial direction from the compressor axis over the cylinders. With this special cooling air flow conduction, an adequate cooling effect can be achieved very compactly.

With a view to achieving a compact construction it is furthermore proposed that the cooling air is drawn in via openings distributed over the periphery of a flange arranged in the region of the drive-side shaft end of the compressing unit or the output-side shaft end of the motor, in order to be blown from there into the cooling air duct by the radial fan. By using this flange region, no additional construction space is required to produce openings for the radial fan. In particular, this solution avoids a further axial extension of the air-cooled reciprocating compressor.

According to an additional aspect of the invention, the filtered air enters a connecting line between the cylinder head and crankcase, wherein there a portion of the filtered air flows in the direction of the cylinder head for compression and another portion to the crankcase for internal cooling of the bearing points present there. In order not to preheat the cooling air disadvantageously before it reaches the action point inside the crankcase, it is proposed that the cooling air is conducted into the crankcase in ducts arranged separately from the cylinder. As a result, preferably filtered in-drawn air from the environment is divided at a point where it is still cool and conducted firstly into the cylinders for compression and secondly passed through the crankcase, wherein the cooling air flowing through the crankcase is divided inside the housing preferably uniformly according to the chambers and components to be cooled, in order to achieve a particularly high efficiency of the internal cooling.

Preferably before being heated by the heat emitted from the cylinders, the in-drawn filtered air is divided by a pipe branch such that it is supplied firstly to the cylinder head for compression and secondly to the crankcase for cooling. Then, the cooling air can be divided uniformly inside the crankcase according to the chambers and components to be cooled.

According to a further aspect improving the invention, the cooling air duct is designed as a sound-insulating housing. Thus noise emissions from the cooling air flow can be avoided. With this measure, a noise protection measure is therefore already applied in the construction of the cooling air duct itself.

Alternatively however it is also possible to construct the cooling air duct with as compact as possible a constructional adaptation to the existing geometric dimensions of the compressing unit, wherein where applicable other sound-insulating measures may be taken, for example by integration of sound-insulating materials. These can also cover other sound-emitting components of the crankcase, in particular cylinder heads and crankcase.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
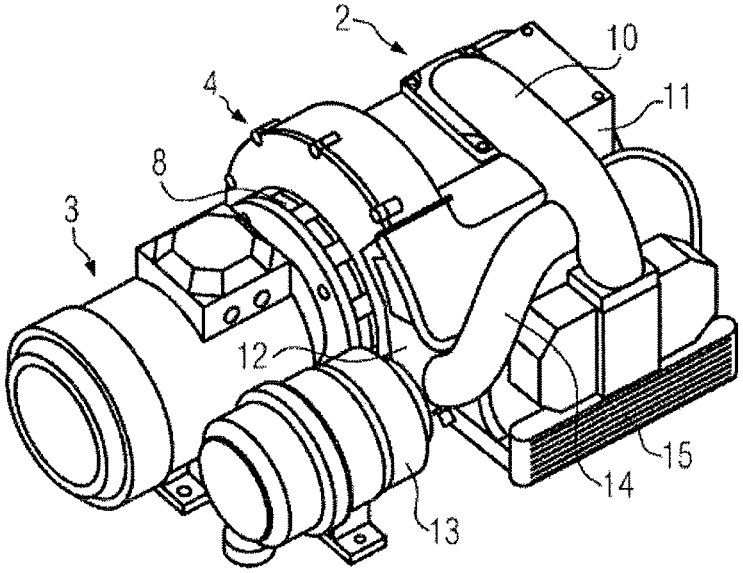
FIG. 1 is a perspective view of an air-cooled reciprocating compressor.

According to FIG. 1, in-drawn filtered air from the environment passes over an air filter 13 via an intake air line 14 into a branching connecting line 10 between the cylinder head 11 and the crankcase 12 of the compressing unit 2. Part of the air flows in the direction of the cylinder head 11 for compression and the remaining part of the air flows into the crankcase 12 to cool internal bearing points. The air drawn in from the outside is therefore divided before being heated by the heat emitted from the compressing unit 2. Heated and hence consumed cooling air leaves the cooling circuit via a cooling air outlet 15.

Axially integrated between the electric motor 3 and the compressing unit 2 is a fan 4, which is formed in the manner of a radial fan. Both the compressing unit 2 and the electric motor 3 are designed in self-centering flange construction and are bolted together over the fan 4 in-between. The air is drawn in via radial openings 8.

Figure 2:
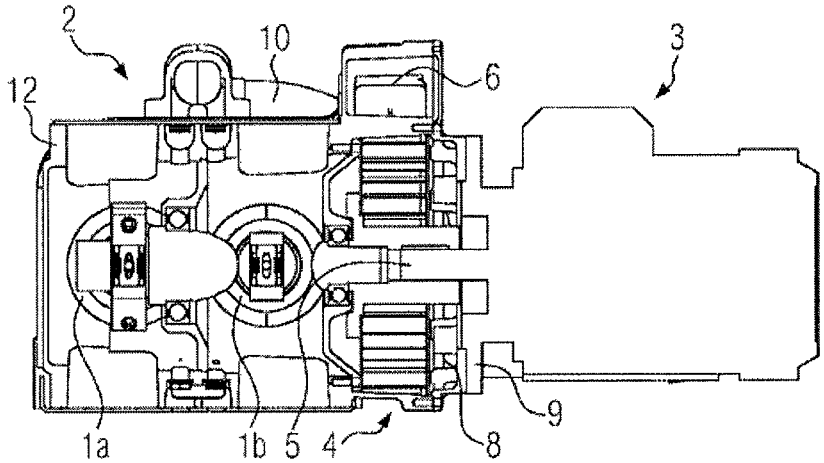
FIG. 2 is a view of an air-cooled reciprocating compressor from below with the compressing unit shown partly cutaway.

According to FIG. 2, the air-cooled reciprocating compressor in its interior has two cylinders 1*a* and 1*b* which are here shown in a view from below. The two cylinders 1*a* and 1*b* are parts of the single-stage oil-free compressing unit 2 which is driven by the electric motor 3.

The fan 4 is arranged on a common connecting shaft 5 driven by the motor 3 and conducted through to the compressing unit 2, via which shaft 5 the fan 4 rotates with the motor rotation speed in order to draw in cooling air from the environment and deliver it into a cooling air duct 6 downstream of the fan 4. The cooling air duct 6, subsequently completely surrounding the cylinders 1*a* and 1*b*, is formed such that cooling air flows uniformly around the two in-line cylinders 1*a* and 1*b* of the compressing unit 2 as described above.

The cooling air duct 6 conducts the consumed cooling air combined in the flow direction after the two cylinders 1*a* and 1*b* into a common extraction air duct from where the combined consumed cooling air is conducted towards the outside. In this embodiment example the cooling air conduction is controlled such that the fan 4 first blows the cooling air radially away from the rotation axis of the compressing unit 2, whereafter a deflection of the cooling air flow by the cooling air duct 6 takes place first in the axial direction of the compressor axis and then again in the radial direction away from the compressor axis over the cylinders 1*a* and 1*b*.

The air-cooled reciprocating compressor has openings 8 distributed over the periphery of a flange 9 of the motor 3, from which point the cooling air enters the fan 4 compactly.

For additional internal cooling of the compressing unit 2, a connecting line 10 is provided which conducts part of the in-drawn air to the cylinders 1*a* and 1*b* for compression but branches off another part for internal cooling.

Figure 3:
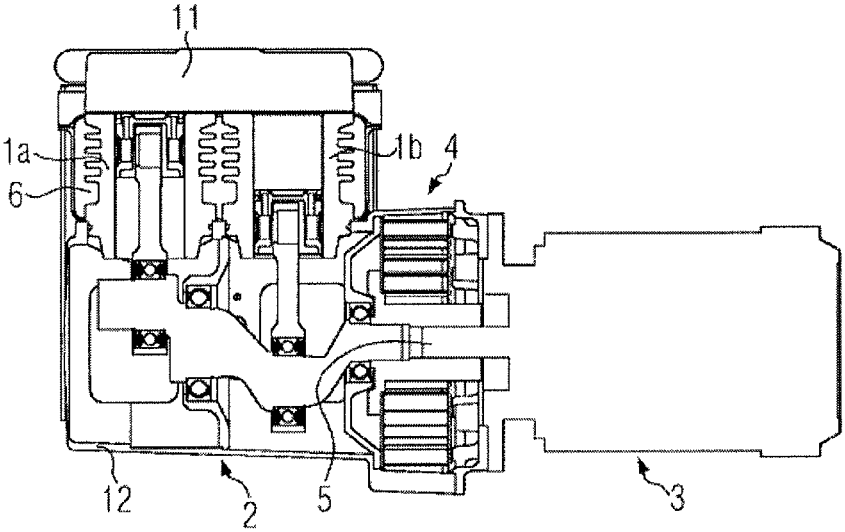
FIG. 3 is a view of a reciprocating compressor according to FIG. 1 from the side, also with the compressing unit being shown partly cutaway.

The filtered air to be compressed passes via the connecting line 10 into the region of the cylinder head 11 shown in FIG. 3 which covers the two cylinders 1*a* and 1*b* and contains inlet and outlet valves, not shown in detail. The other part of the filtered air flows through the crankcase 12 of the compressing unit 2 for internal cooling. In particular the internal bearing points are supplied with cooling air.

As can be seen, a part of the cooling air duct 6 surrounds the two cylinders 1*a* and 1*b* from the outside in order to guarantee that cooling air flows in the desired uniform manner around the two in-line cylinders 1*a* and 1*b*.

LIST OF REFERENCE NUMERALS

1 Cylinder
2 Compressing unit
3 Motor
4 Fan
5 Connecting shaft
6 Cooling air duct
7 Extraction air duct
8 Openings
9 Flange
10 Connecting line
11 Cylinder head
12 Crankcase
13 Air filter
14 Intake air line
15 Cooling air outlet The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An air-cooled reciprocating compressor for a vehicle, comprising:

a compressing unit having a plurality of in-line cylinders;

a motor operatively configured to drive the compressing unit;

a fan operatively arranged to generate a cooling air flow; and a common extraction air duct, wherein:

the fan is arranged on a connecting shaft between the motor and the compressing unit and draws in cooling air from an environment and delivers the cooling air to a downstream located cooling air duct, the fan is a radial fan arranged co-axially between the motor and the compressing unit and blows the cooling air radially away from a rotational axis of a crankshaft of the compressing unit, the cooling air duct is operatively configured to at least partially surround all of the plurality of in-line cylinders within a common cylinder cooling portion of the cooling air duct such that cooling air in the common portion is flowable uniformly around all the plurality of in-line cylinders of the compressing unit, the cooling air duct is operatively configured to deflect the cooling air radially blown by the radial fan first in a direction parallel to the crankshaft rotation axis, then into the common cylinder cooling portion toward a plane containing the crankshaft rotational axis and at least a portion of the plurality of in-line cylinders, then radially away from the crankshaft rotational axis along the plurality of in-line cylinders toward the common extraction air duct, and the cooling air duct combines internal flow of the cooling air after passing the cylinders such that the cooling air is extractable from a hot zone of the cylinders via the common extraction air duct, the air-cooled reciprocating compressor further comprising:

openings distributed over a periphery of a flange in a region of a drive-side shaft end of the compressing unit, wherein the cooling air is drawn into the radial fan via the openings.

2. The air-cooled reciprocating compressor according to claim 1, wherein the cooling air duct conducts the cooling air flow around the in-line cylinders on two sides of each cylinder and perpendicular to a rotational direction of the compressing unit.

3. The air-cooled reciprocating compressor according to claim 1, wherein cross-sections of the cooling air duct are configured such that a cylinder closest to the fan undergoes a reduction in cooling air supply due to a constriction of the cross-section.

4. The air-cooled reciprocating compressor according to claim 1, wherein the cooling air duct comprises a two-piece plastic housing forming the cooling air duct.

5. The air-cooled reciprocating compressor according to claim 1, wherein the compressing unit is a single-stage reciprocating compressor having the plurality of in-line cylinders.

6. The air-cooled reciprocating compressor according to claim 5, wherein the compressing unit is an oil-free reciprocating compressor.

7. The air-cooled reciprocating compressor according to claim 1, wherein the compressing unit is an oil-free reciprocating compressor.

8. The air-cooled reciprocating compressor according to claim 1, wherein in-drawn filtered air from the environment enters a connecting line between a cylinder head and a crankcase of the compressing unit; and wherein a portion of the air flows from there in a direction of the cylinder head for compression and a remaining part of the air flows into the crankcase to cool internal bearing points.

9. The air-cooled reciprocating compressor according to claim 8, wherein before being heated by heat emitted from the cylinders, the in-drawn filtered air is divided and supplied first to the cylinder head for compression and second to the crankcase for cooling.

10. The air-cooled reciprocating compressor according to claim 1, wherein before being heated by heat emitted from the cylinders, in-drawn filtered air is divided and supplied first to a cylinder head for compression and second to a crankcase for cooling.

11. The air-cooled reciprocating compressor according to claim 1, wherein the cooling air duct is formed as a sound-insulating housing to suppress noise caused by the air flow.

12. A vehicle, comprising:

a compressed air consumer arranged in the vehicle;

an air-cooled reciprocating compressor for supplying air to the compressed air consumer in the vehicle;

wherein the air-cooled reciprocating compressor comprises:

a compressing unit having a plurality of in-line cylinders;

a motor operatively configured to drive the compressing unit;

a fan operatively arranged to generate a cooling air flow; and a common extraction air duct, wherein:

the fan is arranged on a connecting shaft between the motor and the compressing unit and draws in cooling air from an environment and delivers the cooling air to a downstream located cooling air duct, the fan is a radial fan arranged co-axially between the motor and the compressing unit and blows radially away from a rotational axis of a crankshaft of the compressing unit, a common cylinder cooling portion of the cooling air duct is operatively configured to at least partially surround all of the plurality of in-line cylinders such that cooling air in the common portion is flowable uniformly around all the plurality of in-line cylinders of the compressing unit, the cooling air duct is operatively configured to deflect the cooling air radially blown by the radial fan first in a direction parallel to the crankshaft rotation axis, then into the common cylinder cooling portion toward a plane containing the crankshaft rotational axis and at least a portion of the plurality of in-line cylinders, and then radially away from the crankshaft rotational axis along the plurality of in-line cylinders toward the common extraction air duct, and the cooling air duct combines internal flow of the cooling air after passing the cylinders such that the cooling air is extractable from a hot zone of the cylinders via the common extraction air duct, the air-cooled reciprocating compressor further comprising:

openings distributed over a periphery of a flange in a region of a drive-side shaft end of the compressing unit, wherein the cooling air is drawn into the radial fan via the openings.

13. The vehicle according to claim 12, wherein the vehicle is an electric vehicle.

14. The vehicle according to claim 12, wherein the vehicle is a hybrid vehicle.

15. The vehicle according to claim 12, wherein the vehicle is a commercial vehicle.

* * * * *